US008858222B1

(12) United States Patent
Adams

(10) Patent No.: US 8,858,222 B1
(45) Date of Patent: Oct. 14, 2014

(54) LOW ENERGY LASER-INDUCED IGNITION OF AN AIR-FUEL MIXTURE

(75) Inventor: Steven F. Adams, New Carlisle, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 937 days.

(21) Appl. No.: 12/780,324

(22) Filed: May 14, 2010

(51) Int. Cl.
*F23N 5/20* (2006.01)

(52) U.S. Cl.
USPC ..... 431/6; 431/8; 431/1; 431/2; 431/258

(58) Field of Classification Search
USPC ..... 431/6, 8, 1, 2, 258; 102/202.5, 402; 372/23, 25, 30, 77
See application file for complete search history.

(56) References Cited

U.S. PATENT DOCUMENTS

| | | | | |
|---|---|---|---|---|
| 3,214,563 | A * | 10/1965 | Ford | 219/69.17 |
| 4,203,078 | A * | 5/1980 | Daugherty et al. | 372/57 |
| 4,947,640 | A | 8/1990 | Few et al. | |
| 5,212,709 | A | 5/1993 | Mihm | |
| 5,497,612 | A | 3/1996 | Few et al. | |
| 5,524,429 | A | 6/1996 | Few et al. | |
| 5,598,699 | A | 2/1997 | Few et al. | |
| 5,673,550 | A | 10/1997 | Few et al. | |
| 5,754,572 | A * | 5/1998 | Pinto et al. | 372/20 |
| 5,876,195 | A | 3/1999 | Early | |
| 6,371,000 | B1 | 4/2002 | Hutmacher et al. | |
| 6,394,788 | B1 | 5/2002 | Early et al. | |
| 6,514,069 | B1 | 2/2003 | Early et al. | |
| 7,345,430 | B2 | 3/2008 | Adler | |
| 7,465,900 | B2 | 12/2008 | Adler | |
| 2008/0156219 | A1 | 7/2008 | Voss et al. | |

OTHER PUBLICATIONS

Adams, S. F., et al., "Resonant Laser Induced Breakdown for Fuel-Air Ignition," AIAA 2010-646, 48th AIAA Aerospace Sciences Meeting, Jan. 4-7, 2010.

Adams, S. F., et al., Formation and Electron-Ion Recombination of N4+ Following Photoionization in Near-Atmospheric Pressure N2, The Journal of Chemical Physics, 130, 144316, Apr. 14, 2009.

Umbel, J. F., et al., "Investigation of O2(C3II, v=2) by Novel Laser Photoionization Technique in Air at Atmospheric Pressure (Abstract)," Proceedings of 62nd International Symposium on Molecular Spectroscopy, MF10, Columbus OH, 2007.

Umbel, J. F., et al., "Investigation of O2(C3II, v=2) by Novel Laser Photoionization Technique in Air at Atmospheric Pressure (PowerPoint Presentation),"Proceedings of 62nd International Symposium on Molecular Spectroscopy, MF10, Columbus OH, 2007.

* cited by examiner

*Primary Examiner* — Alfred Basichas
(74) *Attorney, Agent, or Firm* — AFMCLO/JAZ; Fredric Sinder

(57) ABSTRACT

A new approach for igniting an air-fuel mixture in a turbine or other engine is disclosed. Resonance-enhanced multiphoton ionization (REMPI) is used to generate volume ionization within an air-fuel flow and induce an ignition arc. The output of a relatively low energy single pulsed ultraviolet laser is aimed across an electric field inside a volume of air to create a pre-ionized channel so that a smaller voltage electric field is sufficient to create an electrical arc that follows the pre-ionized channel and will ignite an air-fuel mixture. Because the arc follows the pre-ionized channel, it can be directed to an optimal location inside an ignition volume for igniting the air-fuel mixture. A specific example embodiment is described using a 287.5 nm wavelength pulsed ultraviolet laser to excite ground state oxygen molecules to a specific excited state having a coincident term energy with a specific nitrogen molecule excited state.

2 Claims, 7 Drawing Sheets

LOW ENERGY LASER-INDUCED IGNITION OF AN AIR-FUEL MIXTURE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to photoionization, and more particularly to using a single pulsed ultraviolet laser to ionize an air-fuel mixture to improve ignition of gas turbine and other engines.

Gas turbine and other engines require igniting an air-fuel mixture, generally in a combustion chamber section of the engine. Most prior art gas turbine igniters work by generating high tension electrical sparks, or arcs, across a pair of electrodes. The sparks are triggered by a very high voltage electric field across the electrodes generated by conventional induction coils or by other methods.

As described in U.S. Pat. No. 5,673,550 to Few et al, "spark igniters are typically positioned at a peripheral, non-optimal position of a combustion chamber, while the fuel spray to be ignited is located in a central portion adjacent to a fuel injector." As also described in the Few et al. patent, spark igniters will degrade over time and can cause engine failure.

The Few et al. patent, as well as U.S. Pat. No. 6,394,788 to Early et al. and other prior art, describe how a laser igniter, using laser light to ignite an air-fuel mixture and begin combustion, could solve many of the problems of spark igniters.

Unfortunately, as described in that prior art, present art laser igniters typically require very high power pulsed lasers to create a high-field breakdown of air and photoelectric effects at an electrode surface. The practical issues of gaining optical access to an ignition volume and integrating a high power pulsed laser near the engine and near the combustion area have been a specific concern.

The primary unrealized goal of the prior art has been to be able to create an ionized channel using a low energy source.

A related unrealized goal of the prior art has been a laser igniter that can guide a lower power laser pulse through a fiber optic cable into an ignition region and still reliably induce ignition of an air-fuel mixture.

SUMMARY OF THE INVENTION

The present invention solves the problems presented in the prior art by using a relatively low energy single pulsed ultraviolet laser to create a pre-ionized channel so that a smaller voltage electric field is sufficient to create an electrical arc, or spark, that follows the pre-ionized channel. The smaller voltage electric field can be created by a single electrode surrounding or near the laser output into the ignition volume of a combustion chamber with the arc following the pre-ionized channel from that electrode to the other side of the ignition volume at ground, eliminating the need for electrodes inside the combustion chamber. Because the arc follows the pre-ionized channel, it can be directed to an optimal location inside the ignition volume for igniting the air-fuel mixture.

The relatively low energy ultraviolet laser pulse is able to ionize the air-fuel flow in the ignition volume by a combination of resonant-enhanced multi-photon absorption, apparent collisional energy transfer within the gas, and finally photoionization of the excited gas.

The laser wavelength is tailored to optimize excitation to a specific molecular oxygen state that is coincident in energy with a metastable molecular nitrogen state in atmospheric air. This appears to allow efficient coupling from a short lived oxygen excited state to a longer lived nitrogen excited state and maximizes the subsequent photoionization efficiency.

Accordingly, the present invention is primarily directed to a method for creating a region, or channel, of ionized air by directing a pulsed collimated light beam through air, where the wavelength of the collimated light is primarily 287.5 nm.

The invention is also directed to a method for creating an electrical arc across an electric field inside a region of air by directing a pulsed collimated light beam across the electric field, where the wavelength of the collimated light is primarily 287.5 nm.

The invention is further directed to a method for igniting an air-fuel mixture in a combustion chamber, the combustion chamber having an electric field across a region of the combustion chamber, by the step of directing a pulsed collimated light beam across the electric field, wherein the wavelength of the collimated light is primarily 287.5 nm.

The invention is yet further directed to a method for creating a region, or a channel, of ionized gas, the gas comprising molecules of at least a first gas and a second gas, by directing a pulsed collimated light beam through the gas, where the wavelength of the collimated light excites electrons of molecules of the first gas to a higher energy state having a coincident term energy with excited molecules of the second gas.

The invention is still further directed to a method for creating a region, or a channel, of ionized gas, the gas comprising molecules of at least a first gas and a second gas, by directing a pulsed collimated light beam through the gas, where the wavelength of the collimated light excites electrons of molecules of the first gas to a higher energy state and a plurality of such excited electrons of the first gas transfer energy to electrons of molecules of the second gas to excite those electrons to a higher energy state.

The invention is finally directed to an apparatus, comprising a source of pulsed collimated light having a primary wavelength of 287.5 nm; and, a voltage supply for creating an electric field.

DETAILED DESCRIPTION

The resonant laser-induced ignition concept of the present invention uses a relatively low energy ultraviolet laser pulse to efficiently induce volume ionization in atmospheric air using a laser tuned to the proper wavelength to achieve resonant-enhanced multiphoton ionization (REMPI). The induced breakdown of an air gap with a novel ultraviolet laser triggering scheme according to the teachings of the present invention provides both spatial and temporal precision to a resulting electrical arc.

The teachings of the present invention are also described in Stephen F. Adams, Jared A. Miles and Adam C. Laber, *Resonant Laser Induced Breakdown for Fuel Air Ignition*, AIAA 2010-646, 48$^{th}$ AIAA Aerospace Sciences Meeting, 4-7 Jan. 2010, Orlando, Fla., which is incorporated by reference into this description.

Key to the example embodiment of the laser excitation approach of the present invention illustrated in this detailed description is the use of a focused pulsed laser near a specific ultraviolet wavelength of 287.5 nm to induce resonant enhanced multi-photon ionization (REMPI) within an electrode gap. With this resonant method, sufficient photoionization can be generated for inducing air breakdown at a relatively low laser power compared to prior art laser breakdown approaches. This low power requirement will allow a compact laser igniter using a solid state laser and fiber optics for convenient optical access to an ignition chamber.

Figure 1:
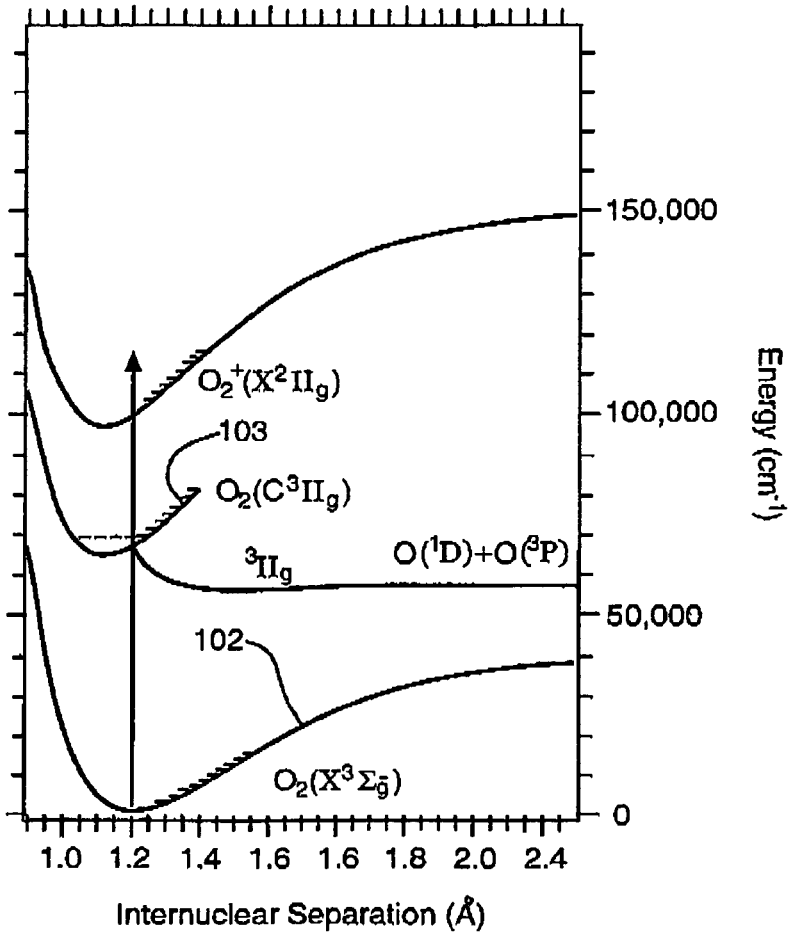
FIG. 1 is a potential energy graph of molecular oxygen showing possible ground and excited states that can be excited in a two photon transition.

The particular resonant laser transition in this example embodiment of the invention that makes it possible to induce breakdown in the flowing air gap of the ignition volume of a combustion chamber involves a little studied REMPI transition in molecular oxygen. FIG. 1 is a potential energy diagram of molecular oxygen. A two-photon transition initially excites a ground state $O_2(X^3\Sigma)$ 102 molecule to an $O_2(C^3\pi,v=2)$ excited state 103. From the $O_2(C^3)$ state, a third photon within the same laser pulse readily ionizes the $O_2$, creating ions and electrons in a laser focus region, called a 2+1 photon REMPI. The $O_2(C^3\pi,v=2)$ excited state is relatively short-lived and normally pre-dissociates after a few picoseconds. In atmospheric air containing both oxygen and nitrogen, the $O_2(C)$ may transfer its energy via collision to a longer-lived $N_2(a'^1\Sigma_u,v=1)$ metastable state, which has a coincident term energy. If transfer occurs during a laser pulse, then the much longer lived $N_2(a')$ could be ionized in a 2-photon absorption and be responsible for an observed abundant photoionization.

Figure 2:
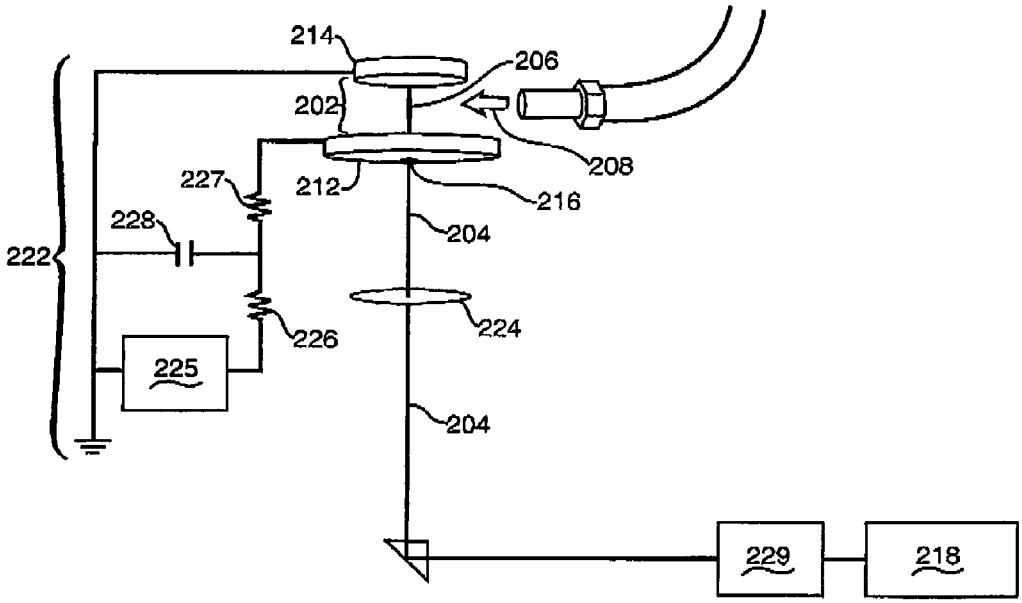
FIG. 2 is a schematic diagram of an experimental layout for a laser induced ignition arc according to the teachings of the present invention.

FIG. 2 shows a diagram of an experimental layout of the invention. An electric field distortion was induced within an ignition gap 202 by application of a beam 204 of focused laser energy which ionized a channel 206 across a region of flowing gas 208 between a pair of electrodes, an anode 212 and a cathode 214. Laser beam 204 passed through an aperture 216 in anode 212 to cross gap 202 and strike cathode 214. This allowed an excessive charge to collect along laser ionization channel 206, forming a space charge region and a local field distortion. Within this high field region between electrodes 212 and 214, there was a greater rate of direct electron impact ionization. If the resulting field distortion was sufficient to sustain electron avalanche across the entire gap 202, then breakdown occurred and a high current electrical arc resulted along channel 206 created by laser beam 204. To demonstrate the precision guidance of the laser induced breakdown technique, laser beam 204 was also propagated across ignition gap 202 at an angle up to 40° to the electric field lines. The resulting arc followed the laser path and not the applied field lines.

Figure 3:
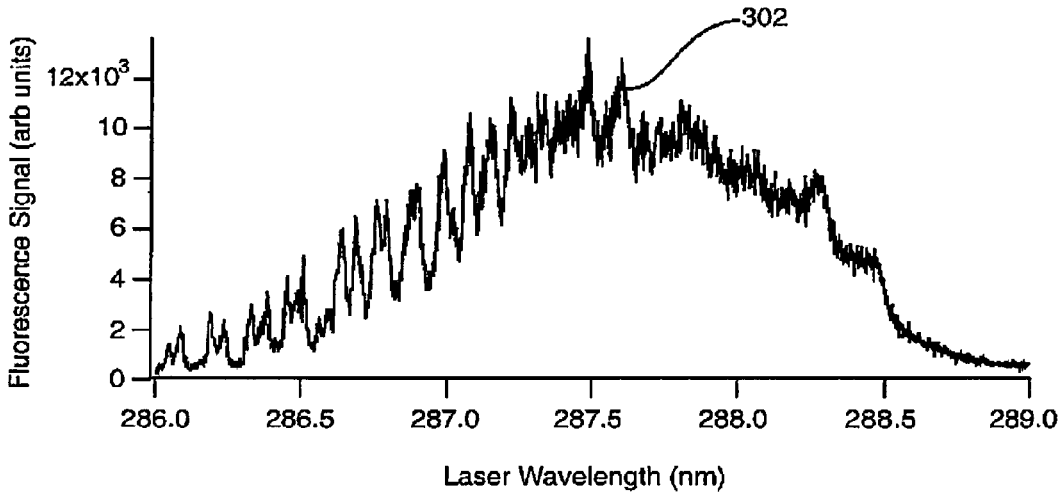
FIG. 3 is a graph of the laser ionization spectrum of $O_2$ in dry air at 760 Torr, showing maximum ionization at 287.5 nm.

Experiments have shown that this REMPI transition in a focused laser beam at 287.5 nm creates abundant ionization in dry or humid air at atmospheric pressure. FIG. 3 shows a plot of the degree of photoionization, indicated by a fluorescence signal 302, in atmospheric air as a function of wavelength of the focused ultraviolet laser radiation. Plot 302 shows that the photoionization band has fairly broad line widths and that maximum photoionization occurs at a laser wavelength of 287.5 nm. The amount of photoionization is greater than that produced by a similar REMPI transition in oxygen alone or in nitrogen alone. The spectral features of this photoionization peak in atmospheric air appears to be solely from the $O_2(X^3\Sigma)$ to $O_2(C^3\pi,v=2)$ excitation and not from a nitrogen ground to excited state excitation. That the effect is more pronounced at higher pressures supports that the enhanced photoionization results from collisions between excited state oxygen and nitrogen molecules.

Returning to the FIG. 2 experimental setup, there is shown a YAG pumped dye laser 218 and a high voltage circuit 222. Laser 218 could be fired with single shots or at a repetitive rate of 10 Hz with energy per pulse variable up to about 3 mJ at $\lambda$=287.5 nm. A compact solid state pulsed laser with a wavelength of 1150 nm that could be frequency quadrupled to 287.5 nm would be ideal for a fielded application of this concept. Although Yb-doped silica-fiber lasers have been made at the 1150 nm wavelength, such a commercial pulsed laser has not yet been developed. Therefore, to demonstrate this laser-induced ignition concept, a larger laboratory dye laser system with second harmonic generation (SHG) was used. Laser 218 is a Nd:YAG laser pumped rhodamine 590 dye laser that produces a laser wavelength of $\lambda$=575 nm. The output from laser 218 was sent through a SHG apparatus 229 to produce a wavelength of $\lambda$=287.5 nm to match the $O_2(X^3\Sigma)$ to $O_2(C^3\pi)$ two photon transition wavelength. To allow for variable laser power, the laser output was passed through a beam attenuator. The laser beam was then passed through a 15 cm focal length lens 224 and focused through aperture 216 into inter-electrode gap 202, eventually striking cathode 214. The laser focal region extended across gap 202 with a beam waist of 50 μm and created a continuous channel of high laser energy density between electrodes 212 and 214.

Anode 212 was fixed in position while cathode 214 was adjustable to allow for a variable inter-electrode distance. A gap 202 distance of d=5 cm approximates the dimensions within an advanced ignition chamber, but smaller gaps were also used to characterize the experimental system.

Electrodes 212 and 214 could be rotated together along an axis perpendicular to the plane of FIG. 2 so that laser beam 202 could be directed at an angle to the inter-electrode axis. Resulting electrical arcs generally followed the direction of laser beam 202, and ionized channel 206, showing that the arc could be induced along a path not parallel with the applied electric field lines.

High voltage circuit 222 included a 100 kV variable DC voltage supply 225, a 10 MΩ resistor 226, a 100 kΩ resister 227 and three 2.2 nF capacitors 228 in series which gave a charging time constant of about 10 ms. Once charged, capacitors 228 could be discharged through a circuit switched by the ignition arc within gap 202 and included a 1 MΩ load resistor which limited the discharged current. The 10 Hz laser pulses occurred 100 ms apart, typically providing sufficient time for capacitors 228 to re-charge between laser pulses.

The voltage across gap 202 was measured with a high voltage probe. The threshold breakdown voltage is an important parameter and was found by a measurement of the minimum applied voltage required to reliably cause breakdown in 10 consecutive laser shots. The threshold breakdown voltage in most cases had an uncertainty of about 1 kV.

Figure 4:
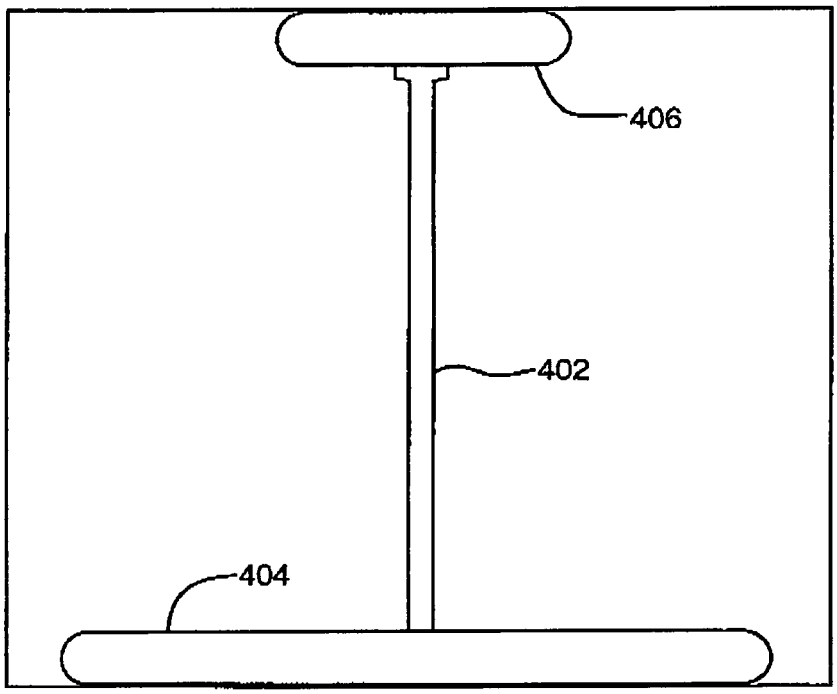
FIG. 4 is a representational view made from a photograph of a resonant laser-induced arc within an air flow ignition gap according to the teachings of the present invention.

FIG. 4 is a representative view made from a digital photograph of a laser induced ignition arc in a d=5 cm air flow gap. A bright arc 402 represents the main arc current that followed the laser beam path from an anode 404 to a cathode 406. This demonstration of reliable laser-induced ignition at a 5 cm spacing was a significant success as that spacing represents a dimensional goal for a practical capability in an aircraft combustion system. FIG. 4 shows a resonant laser effect at $\lambda$=287.5 nm due to the described volume ionization between the electrodes. Laser pulses of equal energy at an off-resonant wavelength of $\lambda$=284.5 nm did not induce breakdown. The air flow is right to left in FIG. 4 at a speed of about 100 m/s.

Figure 5:
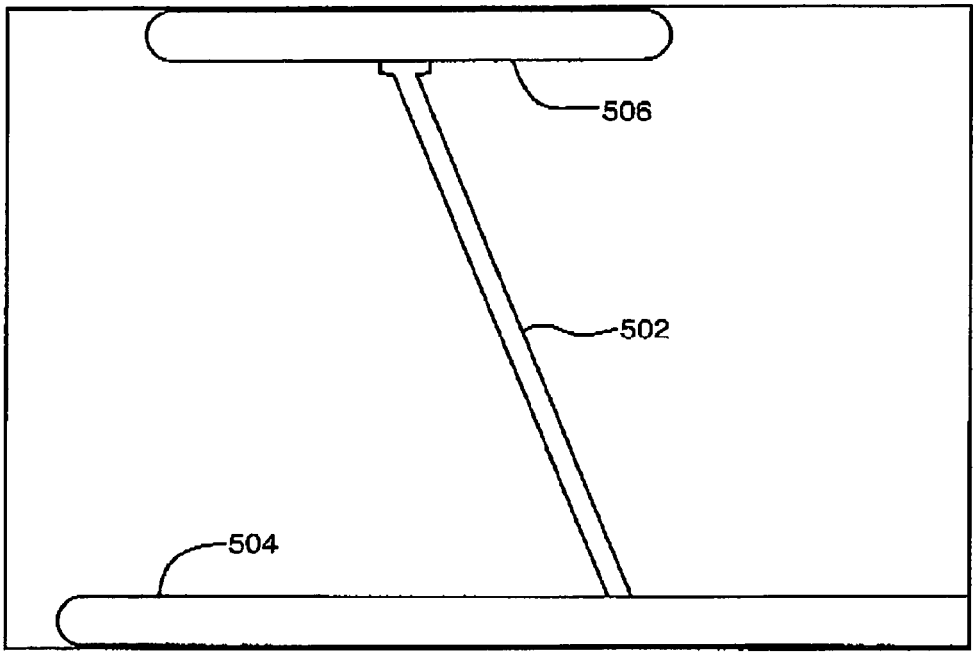
FIG. 5 is a representational view made from a photograph of the precision guidance of a laser-induced arc diagonally across an air flow gap according to the teachings of the present invention.

FIG. 5 shows a representation of a laser-induced arc 502 made from a photograph where the laser was directed across a 2.5 cm gap at an angle of 40° to the electric field lines to demonstrate the precision guidance capability of the invention. The resulting electron avalanche followed the laser path and not the applied field lines which were perpendicular to the electrode surfaces of an anode 504 and a cathode 506. This shows that the resonant laser-induced technique can project an arc along non-trivial paths to reach optimum regions for fuel ignition.

Figure 6:
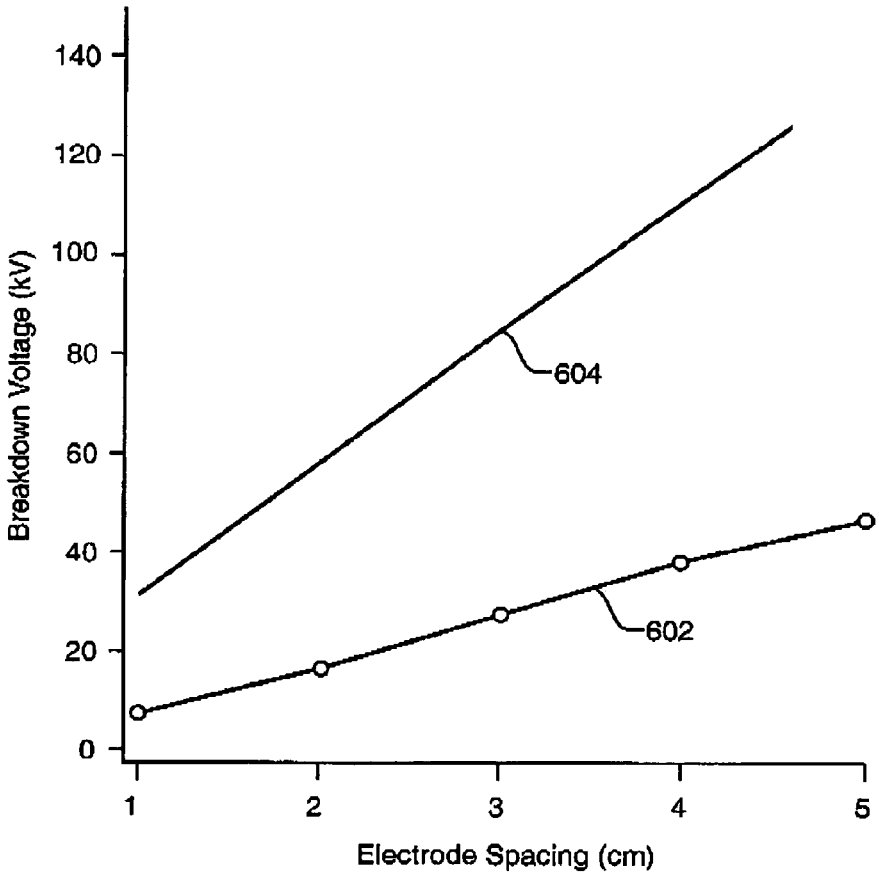
FIG. 6 is a graph of the dependence of experimentally measured threshold laser-induced breakdown voltage, according to the teachings of the present invention, for various gap spacing compared to a standard breakdown voltage for self-breakdown across a gap.
Figure 7:
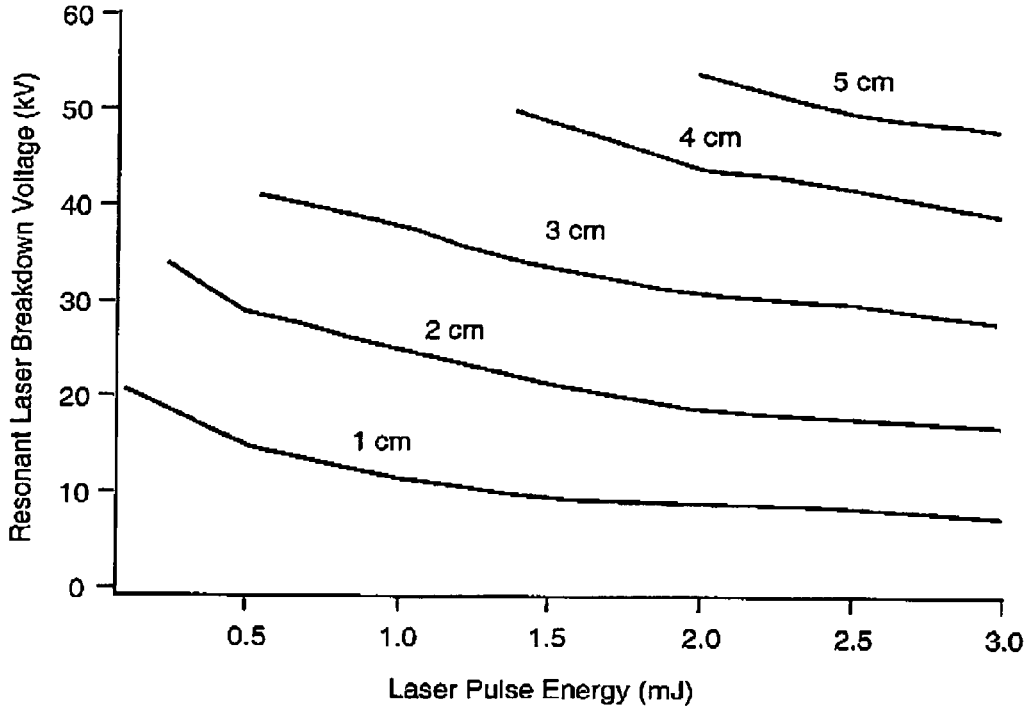
FIG. 7 is a graph of resonant laser breakdown voltage versus laser pulse energy at various gap separation distances.

The threshold breakdown voltage was determined for the resonant laser-induced ignition technique under various conditions. FIG. 6 shows a plot 602 of the dependence of the experimentally measured threshold laser-induced breakdown voltage for various gap spacing and compares it to a plot 604 of a well known standard of $E_b$=30 kV/cm for self-breakdown across a planar gap. The trend in FIG. 6 for laser-induced breakdown across gaps of d=1-5 cm shows that the threshold is about ⅓ of the standard self-breakdown, or about $E_b$=10 kV/cm. FIG. 7 shows plots of resonant laser breakdown voltage versus laser pulse energy at various gap separation distances. The plots show that as pulsed laser energy was decreased, the threshold for laser-induced breakdown increased slightly. At gaps of d=3 cm and less, laser-induced arcing was easily achieved with laser energy below 1 mJ.

Resonant laser induced breakdown of an ignition gap utilizing REMPI processes will improve the spatial and temporal precision of arc ignition in aircraft combustion. As shown in this specific example illustration of the principals of the present invention, resonant laser-induced ignition is reliable across gap spacings as large as 5 cm and guided at an angle as high as 40° to the electric field, demonstrating its practicality and precision guidance. This shows that a resonant laser-induced arc can be guided with precision into fuel-rich flow regions of a combustion volume and create a more efficient ignition process. The laser pulse energy required to induce breakdown is shown to be less than 1 mJ and could be much lower. This is two orders of magnitude less laser power than required to induce an arc through laser electric-field volume breakdown. The wave-length specific multi-photon resonance approach of the present invention requires three photons, two for resonance and one to ionize, where non-wavelength specific "brute-force" prior art approaches would require eleven photons.

Volume ionization is also more reliable and less destructive than using a photoelectric effect method of focusing a non-resonant laser on one of the arc electrodes. Laser-induced breakdown was accomplished with an applied voltage as low as 33% of the voltage required for self breakdown. This can significantly reduce the volume and weight of an igniter electronic package required for aircraft ignition. Future development will result in a compact, low-power laser ignition system with a lower voltage ignition source.

The present invention will be particularly valuable for restarting turbine engines after a failure.

The teachings of the disclosed new approach for igniting air-fuel mixtures in a turbine engine combustion chamber will find application in other areas where creating an ionized channel, or any ionized region, within a gas is required. The claimed invention, and the intended scope of all the claims, therefore, is not limited to the specifically described example embodiment.

Various modifications to the invention as described may also be made, as might occur to one with skill in the art of the invention, within the scope of the claims. Therefore, all contemplated example embodiments have not been shown in complete detail. Other embodiments may be developed without departing from the spirit of the invention or from the scope of the claims.

I claim:

1. A method for creating an electric arc across an electric field inside a region of air, wherein the electric field is created by an anode electrode and a cathode electrode in a spaced relationship, comprising the steps of:

(a) directing a pulsed collimated light beam across the electric field from one electrode to the other, at pulse energies less than required to ionize air by single photon ionization; and, (b) wherein the wavelength of the collimated light is selected to induce resonant enhanced multi-photon ionization, such that a channel of ionized air is created along the path of the light beam, whereby an electric arc will follow the channel of ionized air across the electric field.

2. A method for igniting an air-fuel mixture in a combustion chamber, the combustion chamber having an electric field across a region of the combustion chamber, comprising the steps of:

(a) providing an anode electrode and a cathode electrode in a spaced relationship inside the combustion chamber for creating the electric field;

(b) providing a pulsed laser positioned to direct a beam of light from one electrode to the other;

(c) directing a pulsed collimated beam of light across the electric field from either electrode to the other, at output levels below that required to ignite the air-fuel mixture by the beam of light alone; and, (d) wherein the wavelength of the collimated light is selected to induce resonant enhanced multi-photon ionization.

* * * * *